US007568244B1

(12) United States Patent
Shamie et al.

(10) Patent No.: US 7,568,244 B1
(45) Date of Patent: Aug. 4, 2009

(54) CRIB WITH SAFETY LOCKED DROP SIDE RAIL

(75) Inventors: Sam I. Shamie, Brooklyn, NY (US); Francisco J. Reyes, Brooklyn, NY (US)

(73) Assignee: Delta Enterprise Corp., New York, NY (US)

( * ) Notice: Subject to any disclaimer, the term of this patent is extended or adjusted under 35 U.S.C. 154(b) by 0 days.

(21) Appl. No.: 12/023,232

(22) Filed: Jan. 31, 2008

(51) Int. Cl.
*A47D 7/02* (2006.01)

(52) U.S. Cl. ..... 5/100; 5/93.1

(58) Field of Classification Search ..... 5/93.1, 5/100, 425, 428
See application file for complete search history.

(56) References Cited

U.S. PATENT DOCUMENTS 2,383,167 A * 8/1945 Shaw ..... 5/100
4,724,556 A * 2/1988 Burnham ..... 5/100
4,951,330 A * 8/1990 Burnham ..... 5/93.1
5,072,464 A * 12/1991 Draheim et al. ..... 5/93.1
6,175,974 B1 * 1/2001 Draheim ..... 5/100
6,505,360 B2 * 1/2003 Guillot ..... 5/100
6,922,858 B1 * 8/2005 Shamie ..... 5/100
7,249,388 B1 * 7/2007 Lin ..... 5/100

* cited by examiner

*Primary Examiner*—Michael Trettel
(74) *Attorney, Agent, or Firm*—Richard M. Goldberg

(57) ABSTRACT

A crib includes a headboard and footboard, stabilizer bars connecting the headboard and footboard, a stationary rail closing one side of the crib, a drop side rail, and a connecting arrangement slidably securing the drop side rail to respective vertical posts of the headboard and footboard on an opposite side of the crib. The connecting arrangement includes an elongated guide secured to a vertical post of at least one of the headboard and the footboard, the elongated guide including an opening therein, and a rail lock assembly secured to at least one end of the drop side rail, the rail lock assembly slidably mounted along the elongated guide, the rail lock assembly including a locking member and a biasing arrangement for biasing the locking member into the opening of the elongated guide.

20 Claims, 18 Drawing Sheets

FIG. 9
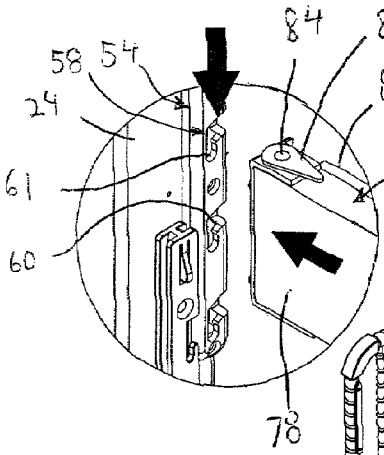
FIG. 10
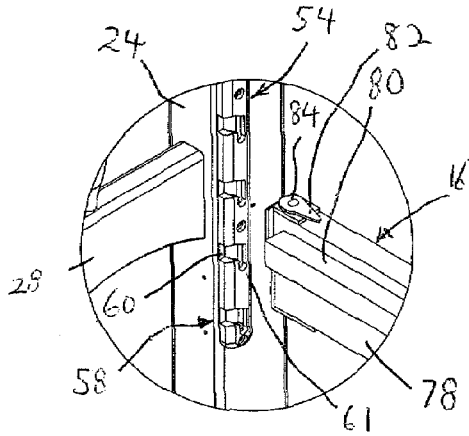
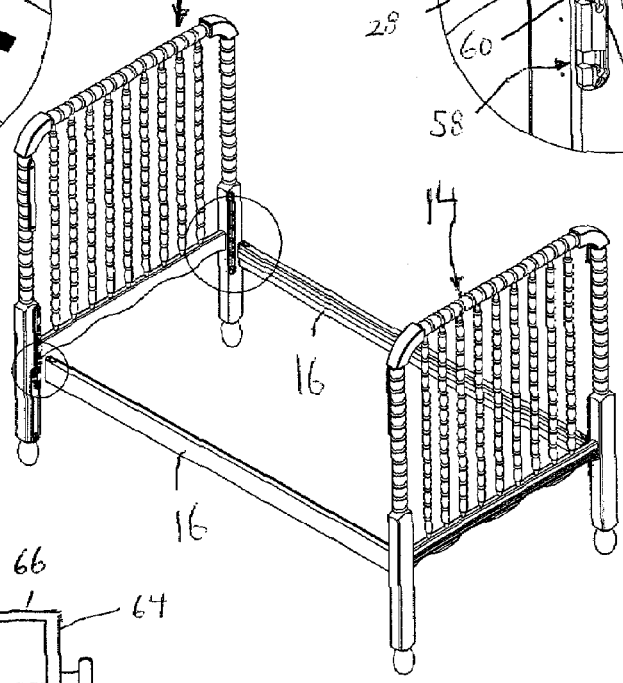
FIG. 8
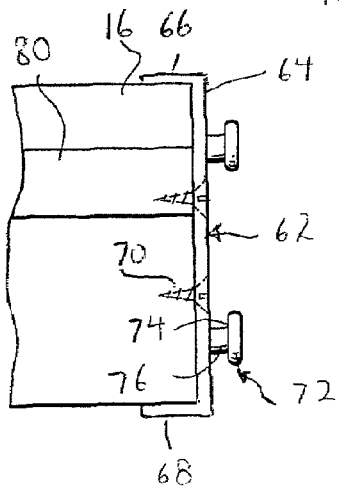
FIG. 11

FIG. 14
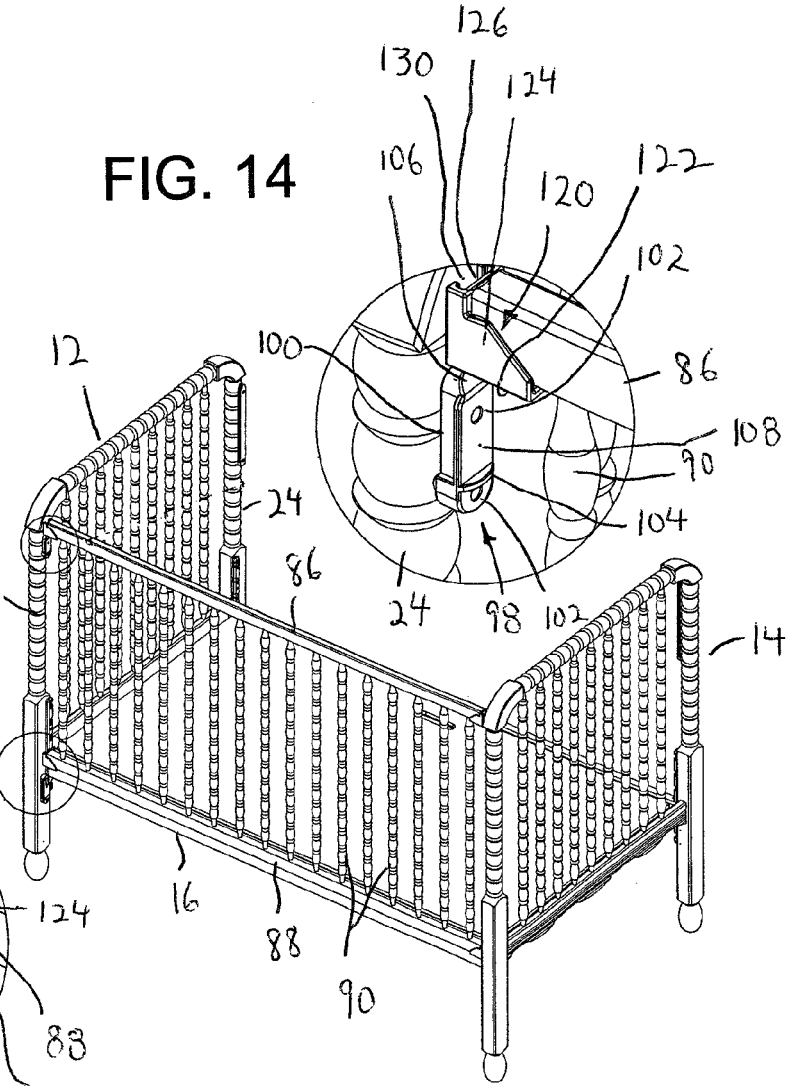
FIG. 13
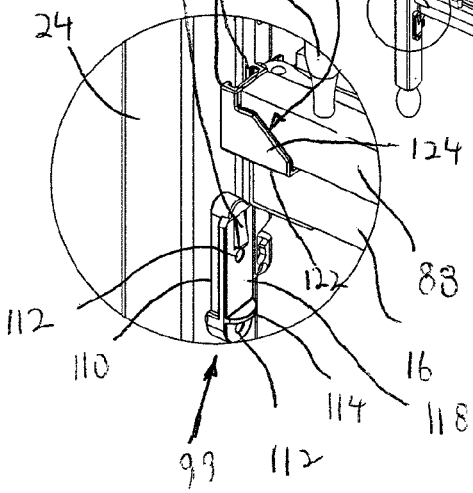
FIG. 15

FIG. 17
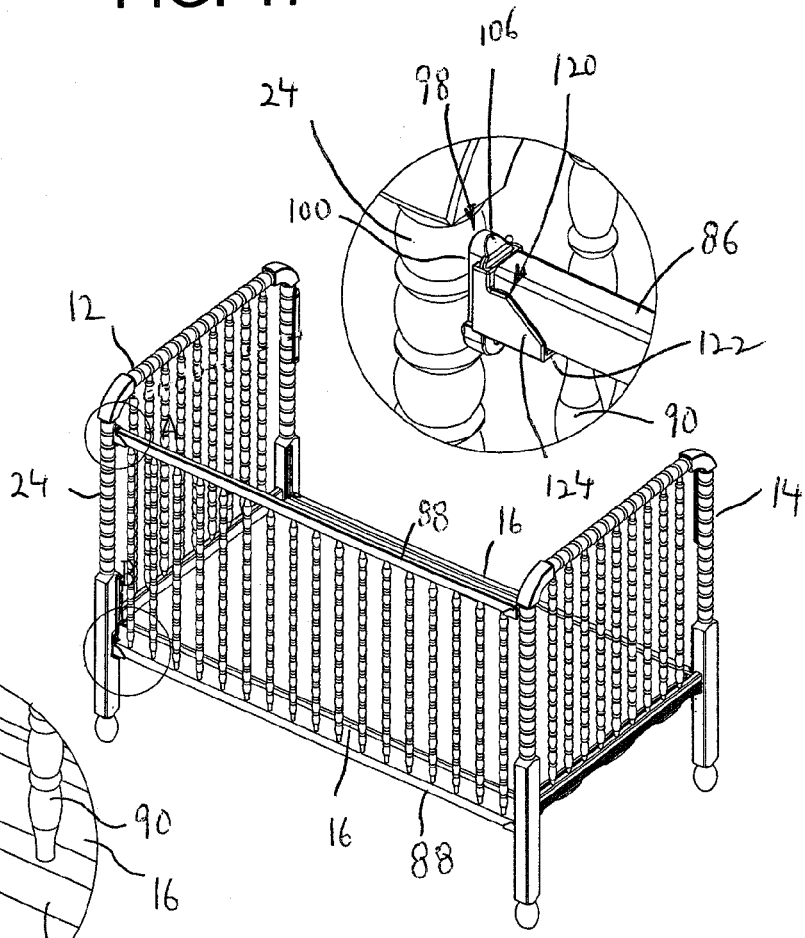
FIG. 16
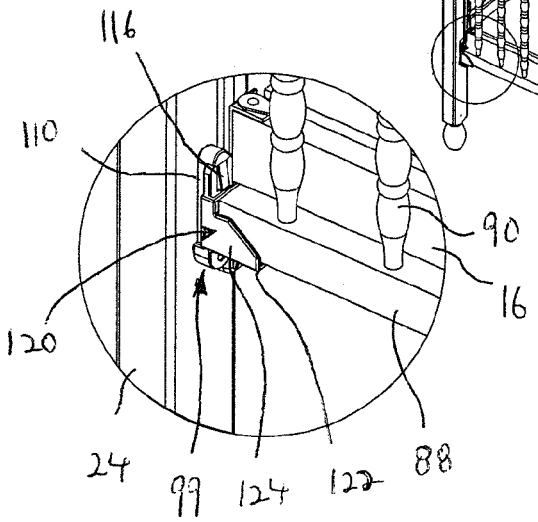
FIG. 18

FIG. 19
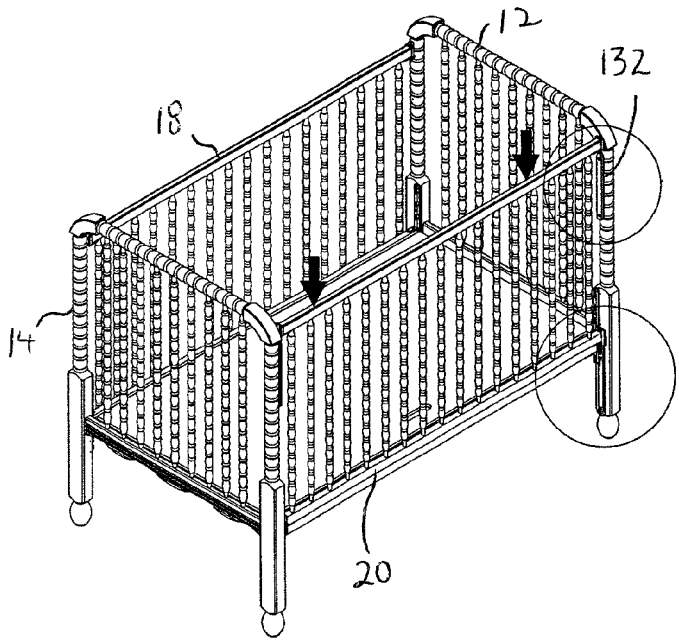
FIG. 20
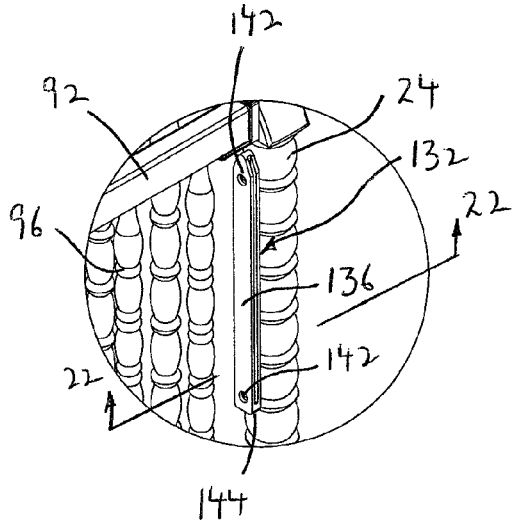
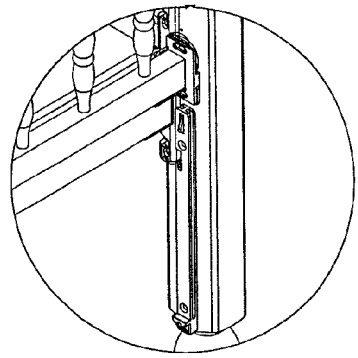
FIG. 21
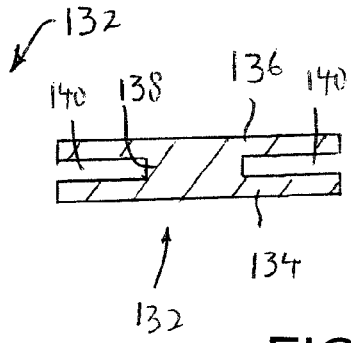
FIG. 22

FIG. 23
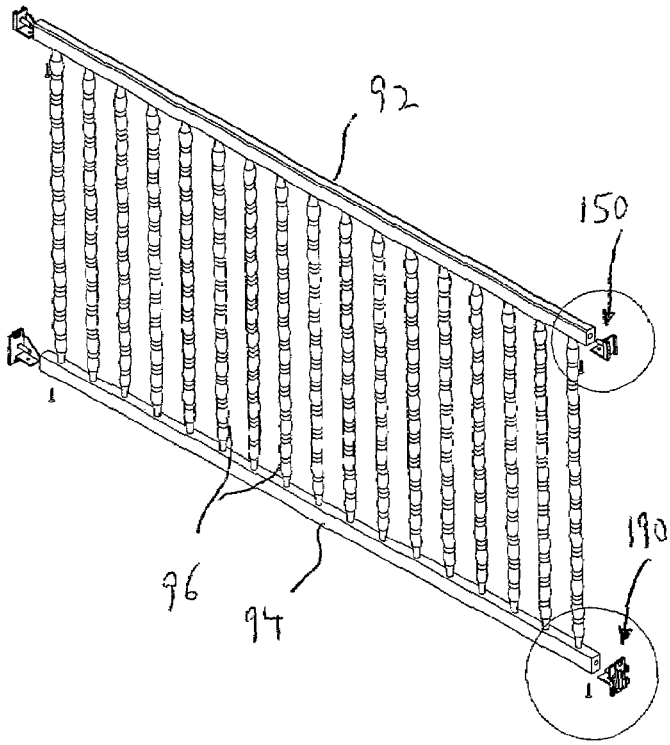
FIG. 24
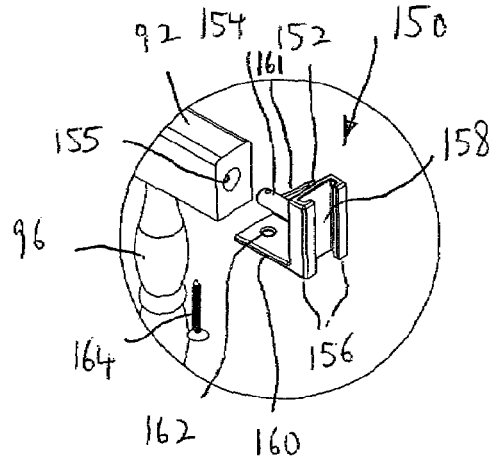
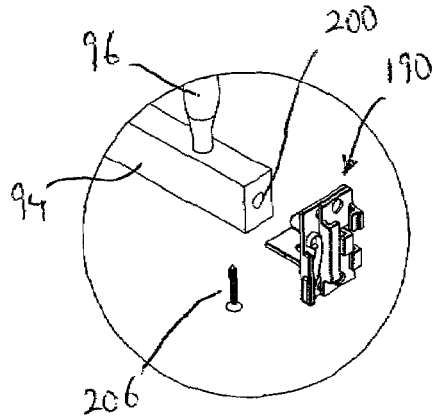
FIG. 25

FIG. 28
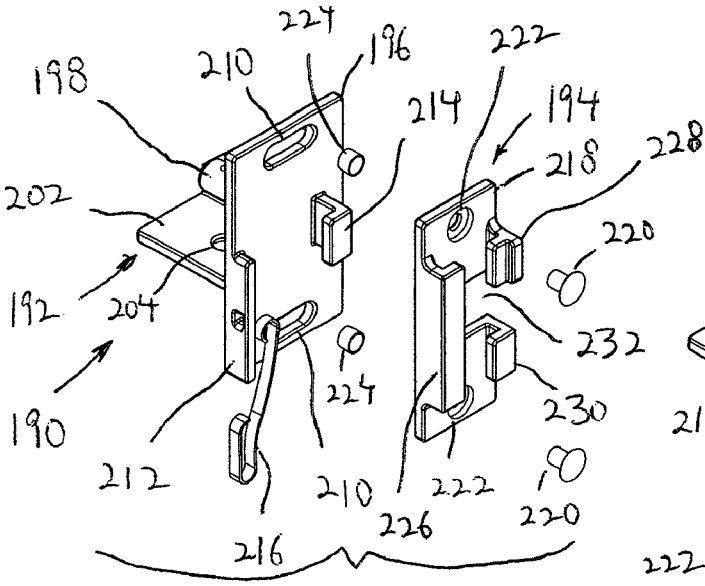
FIG. 29
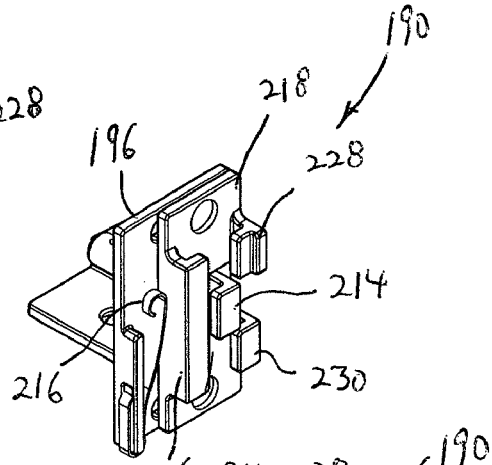
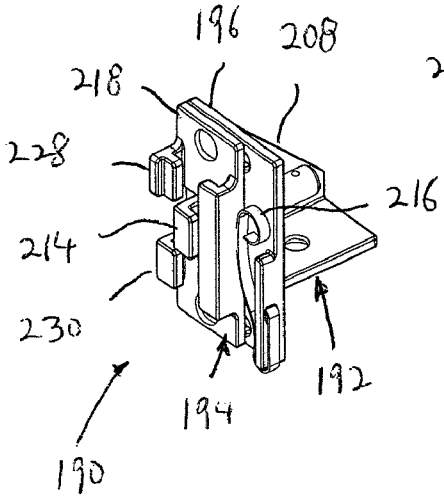
FIG. 31
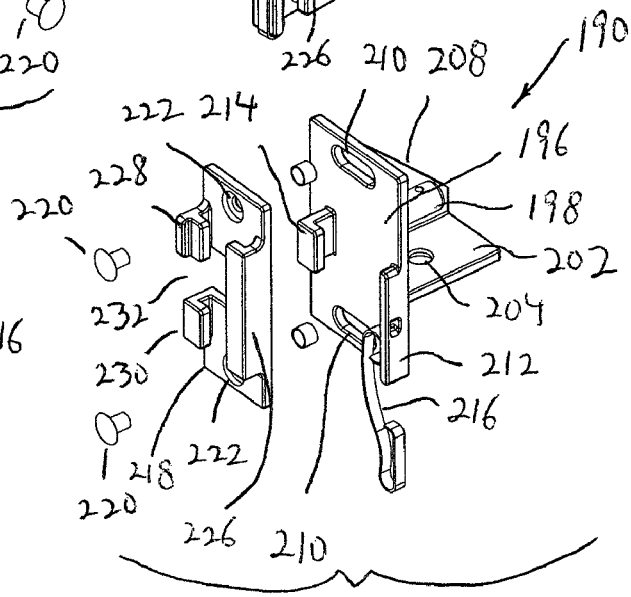
FIG. 30

FIG. 33A
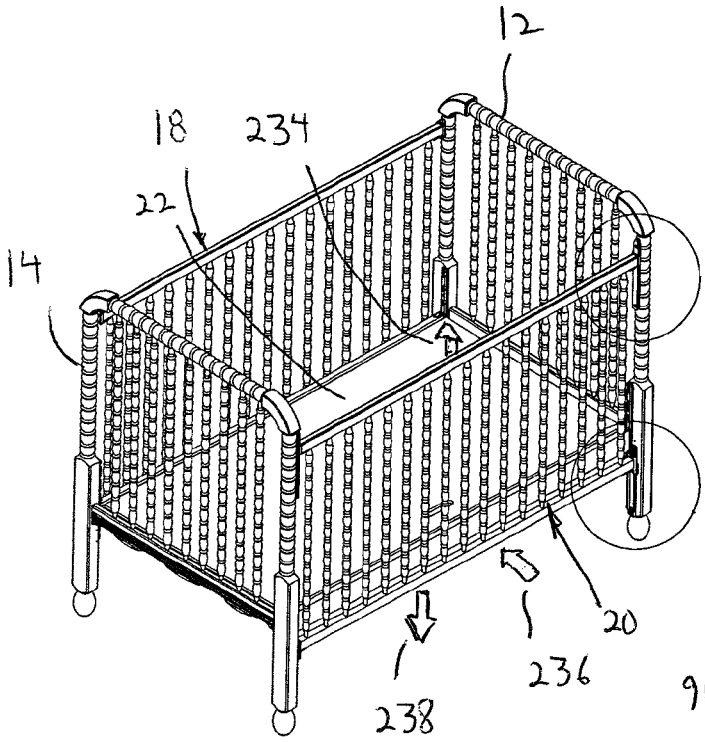
FIG. 32A
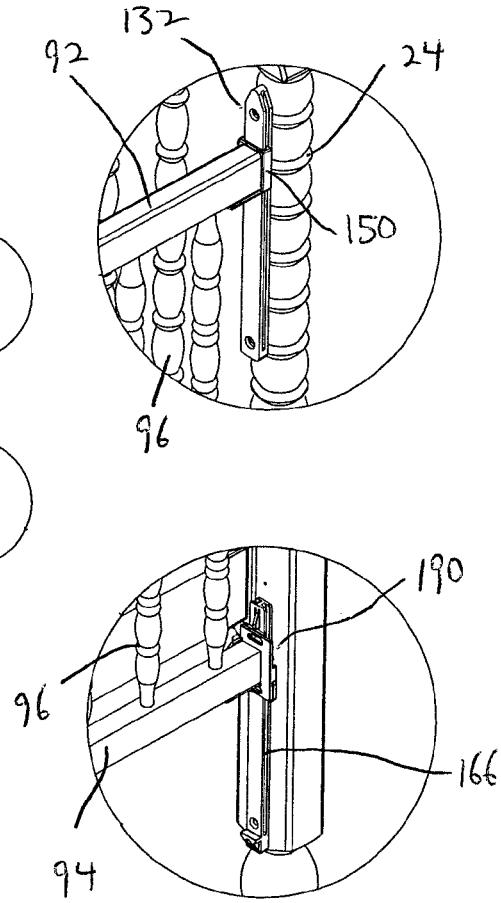
FIG. 34A

FIG. 42A
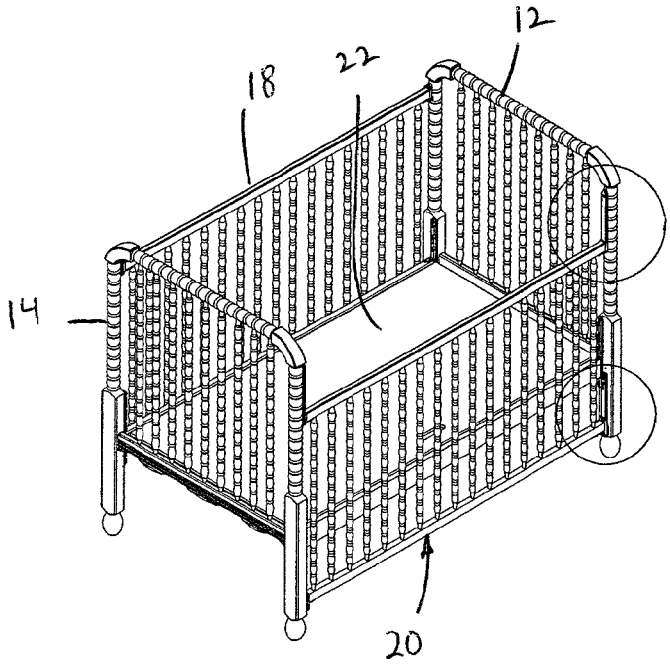
FIG. 41A
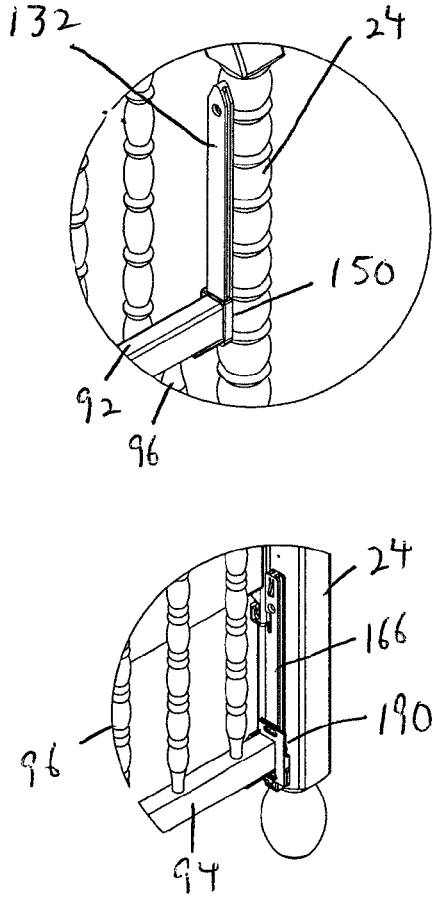
FIG. 43A

CRIB WITH SAFETY LOCKED DROP SIDE RAIL

BACKGROUND OF THE INVENTION

The present invention relates generally to cribs, and more particularly, to a crib with a safety locked drop side rail.

A conventional crib includes a drop side rail that can be lowered to place a child in the crib or to remove the child from the crib. Various arrangements are known for raising and lowering the drop side rail.

One such arrangement is disclosed in U.S. Pat. No. 4,724,556, issued Feb. 16, 1988. Specifically, a bracket is secured to the drop side rail and includes inwardly facing L-shaped ears which engage around a guide plate fixed to a corner post of the crib, to guide the drop side rail between its raised and lowered positions. The bracket includes a bayonet type slot at an upper edge thereof which receives one L-shaped ear in a locking engagement when the drop side rail is raised. In order to lower the drop side rail, the drop side rail is raised and then pushed inwardly to remove the engaged L-shaped ear from the bayonet type slot, whereupon the drop side rail can then be slid down to its lowered position.

During the sliding movement of the drop side rail, both L-shaped ears engage the guide plate to provide a stable sliding motion. However, in its raised, locked position, the L-shaped ear positioned in the bayonet type slot is the only L-shaped ear engaged with the guide plate. As a result, the drop side rail is not very stable. Also, during the lowering operation, when the drop side rail is first raised and then moved inwardly, initially, neither L-shaped ear is in engagement with the guide plate. As the drop side rail is moved further inwardly, the other L-shaped ear is the only ear in engagement with the guide plate, at least until the drop side rail is lowered to the point where the engaged L-shaped ear passes below the bayonet type slot.

Because only one L-shaped ear is in engagement with the guide plate, this can lead to instability of the drop side rail, and it is possible that the bracket can inadvertently become disengaged from the guide plate.

SUMMARY OF THE INVENTION

Accordingly, it is an object of the present invention to provide a crib that overcomes the aforementioned problems.

It is another object of the present invention to provide a crib in which the drop side rail cannot inadvertently be lowered.

It is still another object of the present invention to provide a crib in which the drop side rail cannot inadvertently detach from the crib.

It is still another object of the present invention to provide a crib in which the drop side rail is stably held to the corner posts at all times.

In accordance with an aspect of the present invention, a connecting arrangement for slidably securing the drop side rail to respective vertical posts of the headboard and footboard on an opposite side of the crib, includes an elongated guide secured to a vertical post of at least one of the headboard and the footboard, the elongated guide including an opening therein. A rail guide is slidably mounted along the elongated guide in a lengthwise direction thereof, the rail guide including opposing members that are both always in guiding engagement with opposite sides of the elongated guide. A rail securement member is secured to at least one end of the drop side rail, the rail securement member being slidably connected with the rail guide for sliding movement relative to the rail guide in a direction transverse to the lengthwise direction, the rail securement member including a locking member. A biasing arrangement biases the rail securement member in a transverse direction relative to the rail guide to move the locking member into the opening of the elongated guide. To lower the drop the rail, the drop side member must be moved laterally against a biasing force of the biasing arrangement to remove the locking member from the opening whereupon the rail lock assembly can slide along the elongated guide.

Preferably, the opening in the elongated guide includes an open mouth at one side of the elongated guide, and a blind base extends in open communication with the open mouth in a lengthwise direction of the elongated guide. Thus, to lower the drop side rail, the drop side member must be first raised to remove the locking member from the blind base and into alignment with the open mouth, then moved laterally against a biasing force of the biasing arrangement to remove the locking member from the open mouth of the opening, whereupon the rail lock assembly can slide along the elongated guide.

The biasing arrangement is engaged between the rail securement member and the rail guide for biasing the rail securement member in a transverse direction relative to the rail guide to move the locking member into the opening. The biasing arrangement includes a spring arranged between the first and second members for biasing the first and second members apart.

The elongated guide includes at least one channel, and the opposing members are both always in guiding engagement within the at least one channel. The opposing members include a first L-shaped guide wall at one side of the plate, and a second L-shaped guide wall at an opposite side of the plate. There is also a third L-shaped guide wall at the opposite side of the plate in spaced relation from the second L-shaped guide wall, with a gap therebetween, and the biasing arrangement biases the locking member through the gap and into the opening.

The rail guide includes a first plate and the rail securement member includes a second plate. One of the first and second plates has at least one elongated transverse slot therein and the other of the first and second plates has at least one opening therein. A pin arrangement extends through the at least one opening and is slidably mounted in the at least one elongated transverse slot for slidably mounting the rail securement member relative to the rail guide.

The elongated guide is secured to a lower portion of the vertical post of at least one of the headboard and the footboard, and the rail securement member is secured to a lower portion of the at least one end of the drop side rail.

There is also an elongated upper guide secured to an upper end of the vertical post of the at least one of the headboard and the footboard, and an upper rail guide secured to an upper portion at each end of the drop side rail for sliding engagement with a respective elongated upper guide.

In accordance with another aspect of the present invention, a crib includes a headboard having a pair of spaced apart vertical posts, a footboard having a pair of spaced apart vertical posts, and first and second stabilizer bars, each having opposite ends, along with a connecting arrangement for connecting each end of each stabilizer bar to a respective vertical post. A first side rail is secured to respective vertical posts of the headboard and footboard on one side of the crib. There is also a drop side rail. A connecting arrangement slidably secures the drop side rail to respective vertical posts of the headboard and footboard on an opposite side of the crib. The connecting arrangement includes an elongated guide secured to a vertical post of at least one of the headboard and the footboard, the elongated guide including an opening therein, and a rail lock assembly secured to at least one end of the drop side rail, the rail lock assembly slidably mounted along the elongated guide, the rail lock assembly including a locking member and a biasing arrangement for biasing the locking member into the opening of the elongated guide. To lower the drop the rail, the drop side member must be moved laterally against a biasing force of the biasing arrangement to remove the locking member from the opening whereupon the rail lock assembly can slide along the elongated guide.

The above and other features of the invention will become readily apparent from the following detailed description thereof which is to be read in connection with the accompanying drawings.

BRIEF DESCRIPTION OF THE DRAWINGS

FIG. 8 is a perspective view of the headboard and footboard connected with the stabilizer bars;

FIG. 9 is an enlarged, perspective view of a portion of the one end of the headboard, showing attachment of a stabilizer bar thereto;

FIG. 10 is an enlarged, perspective view of a portion of the opposite end of the headboard, showing attachment of a stabilizer bar thereto;

FIG. 11 is a side elevational view of an end of a stabilizer bar with a pin plate secured thereto;

FIG. 13 is a perspective view showing the initial assembly of the stationary rail;

FIG. 14 is an enlarged, perspective view of the upper portion of the initial assembly of FIG. 13;

FIG. 15 is an enlarged, perspective view of the lower portion of the initial assembly of FIG. 13;

FIG. 16 is a perspective view showing the final assembly of the stationary rail;

FIG. 17 is an enlarged, perspective view of the upper portion of the final assembly of FIG. 16;

FIG. 18 is an enlarged, perspective view of the lower portion of the final assembly of FIG. 16;

FIG. 19 is a perspective view showing initial assembly of the drop side rail to the crib;

FIG. 20 is an enlarged, perspective view of the upper portion of the initial assembly of the drop side rail of FIG. 19;

FIG. 21 is an enlarged, perspective view of the lower portion of the initial assembly of the drop side rail of FIG. 19;

FIG. 22 is a cross-sectional view of the elongated upper guide of FIG. 20, taken along line 22-22 thereof;

FIG. 23 is a perspective view of the drop side rail with the hardware at the ends of the upper and lower rail members thereof in an exploded view;

FIG. 24 is an exploded perspective view of one end of the upper rail member of the drop side rail with the hardware therefor;

FIG. 25 is an exploded perspective view of one end of the lower rail member of the drop side rail with the hardware therefor;

FIG. 28 is an exploded, perspective view of the lower rail lock assembly for the headboard;

FIG. 29 is an assembled, perspective view of the lower rail lock assembly for the headboard;

FIG. 30 is an exploded, perspective view of the lower rail lock assembly for the footboard;

FIG. 31 is an assembled, perspective view of the lower rail lock assembly for the footboard;

FIG. 32A is a perspective view of the crib with the drop side rail in its upper locked position;

FIG. 33A is an enlarged perspective view of an upper corner of the crib of FIG. 32A, showing the drop side rail in its upper locked position;

FIG. 34A is an enlarged perspective view of a lower corner of the crib of FIG. 32A, showing the drop side rail in its upper locked position;

FIG. 41A is a perspective view of the crib with the drop side rail in its lowered position;

FIG. 42A is an enlarged perspective view of an upper corner of the crib of FIG. 41A, showing the drop side rail in its lowered position;

FIG. 43A is an enlarged perspective view of a lower corner of the crib of FIG. 41A, showing the drop side rail in its lowered position.

DETAILED DESCRIPTION

Figure 1:
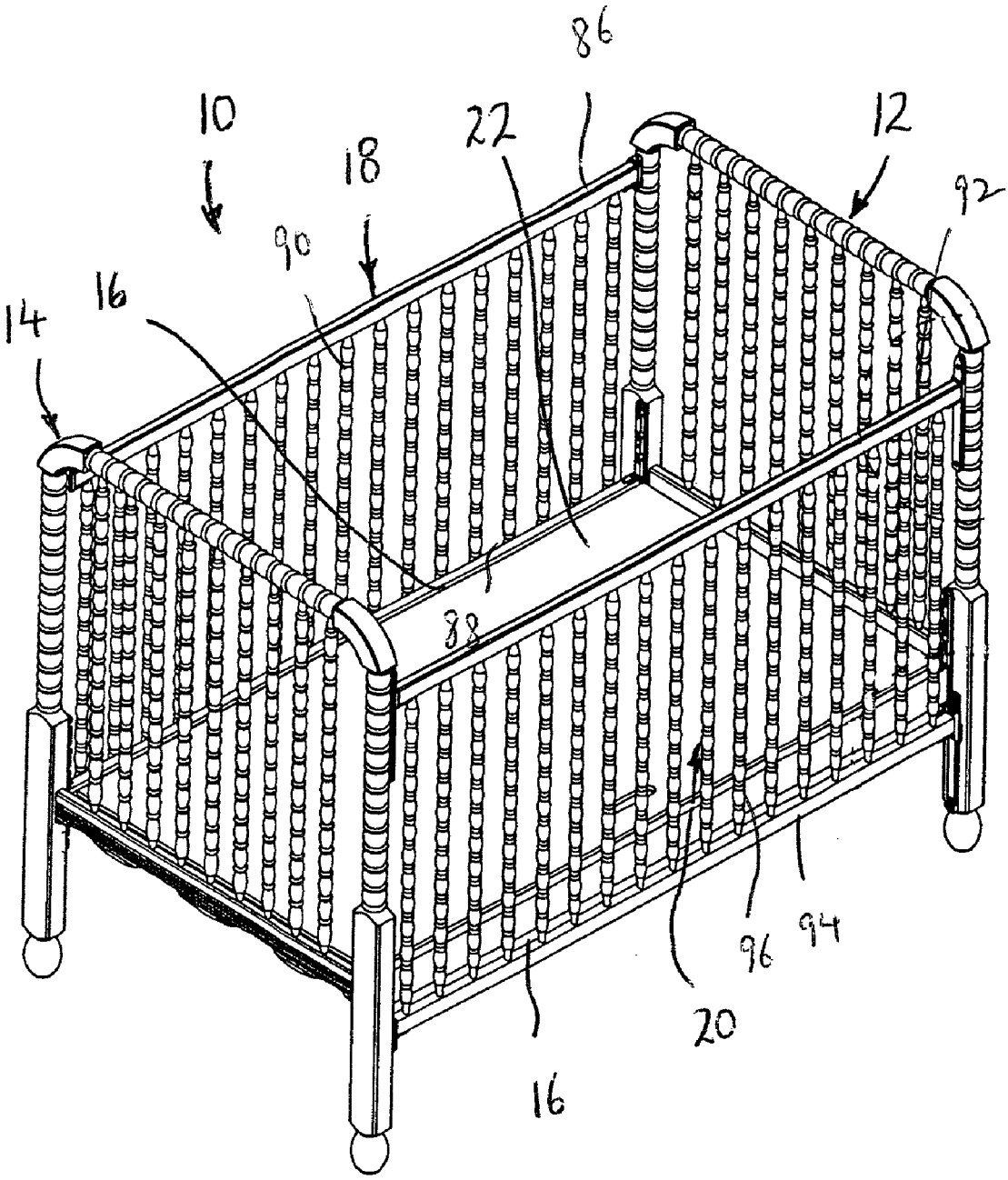
FIG. 1 is a perspective view of a crib according to the present invention.
Figure 2:
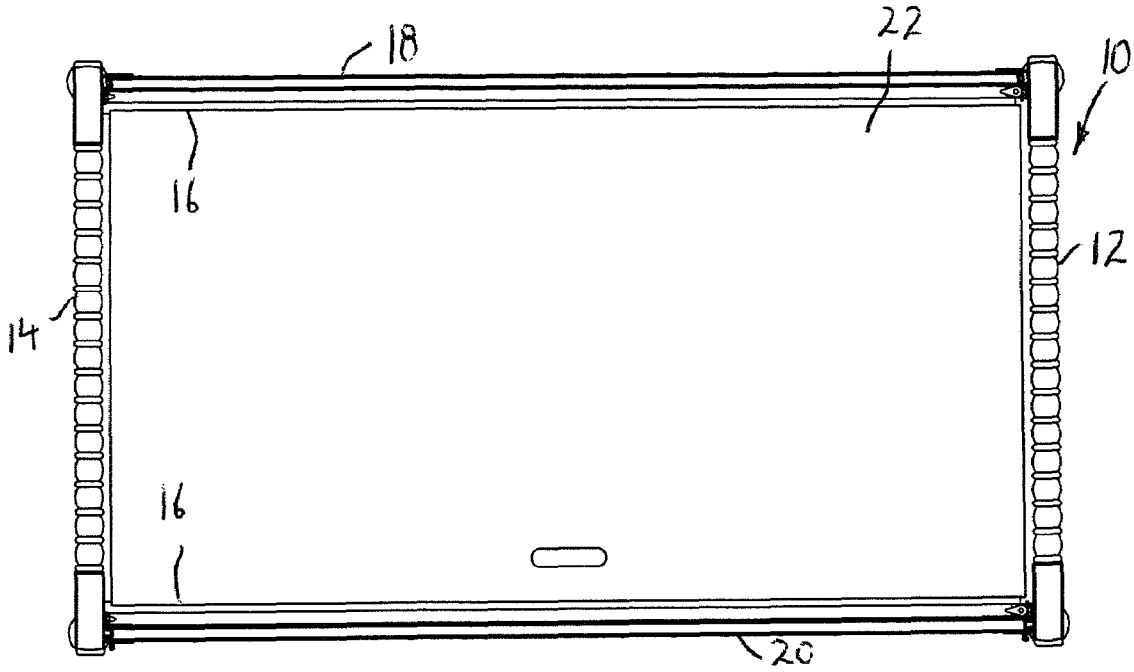
FIG. 2 is a top plan view of the crib.
Figure 3:
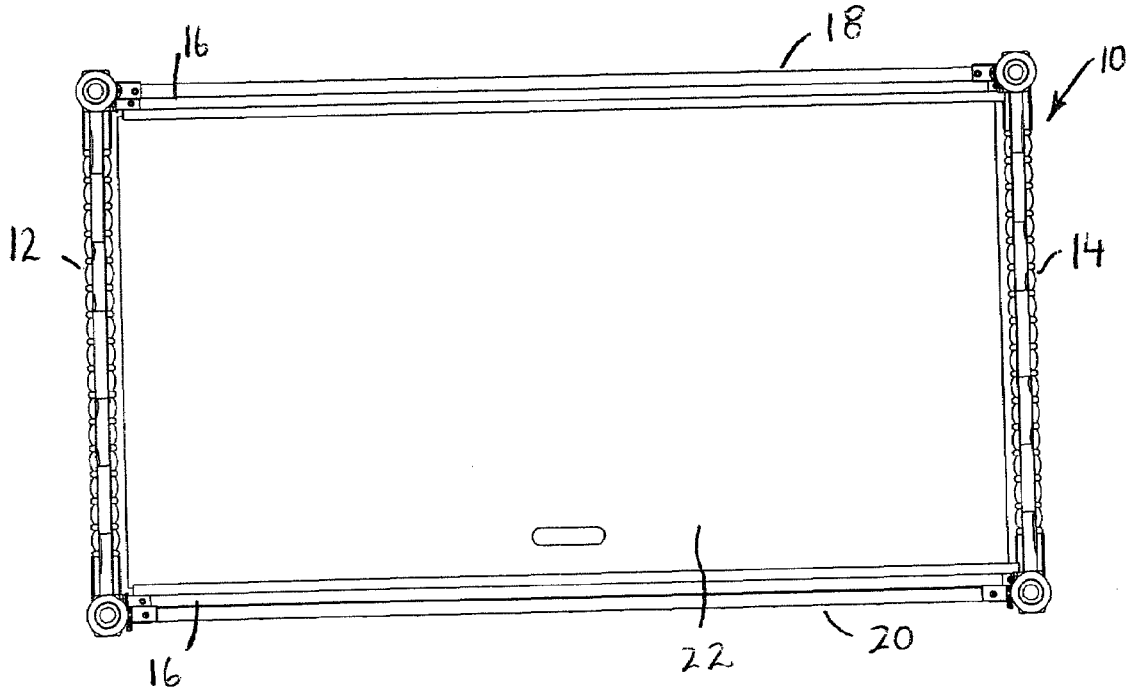
FIG. 3 is a bottom plan view of the crib.

Referring to the drawings in detail, and initially to FIGS. 1-5 thereof, a crib 10 according to the present invention includes a headboard 12 and a footboard 14 connected together in a parallel, spaced apart relation to each other at lower positions thereat by two parallel, spaced apart stabilizer bars 16. Stabilizer bars 16 can be connected to headboard 12 and footboard 14 in any suitable manner such as screws or the like, but preferably, are connected in accordance with the teachings in U.S. Pat. No. 4,639,956, issued Feb. 3, 1987, the entire disclosure or which is incorporated herein by reference. A first side of crib 10 is closed by a stationary rail 18, while the opposite side is closed by a drop side rail 20 which can be lowered or raised. A mattress support 22 is supported by stabilizer bars 16 for supporting a mattress (not shown) thereon. The mattress support 22 can include, but is not limited to, a mattress board, a slat assembly, a steel spring deck, etc.

Figure 6:
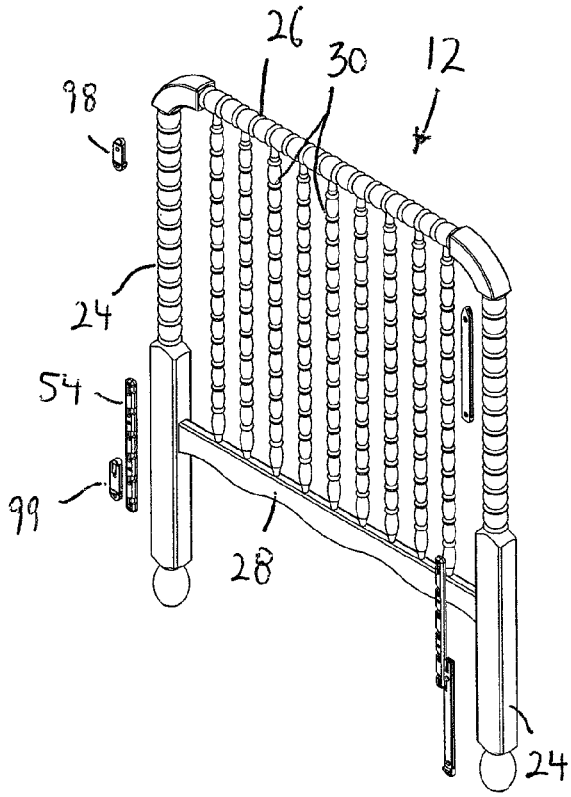
FIG. 6 is a perspective view of the headboard of the crib.

As shown best in FIG. 6, headboard 12 is formed by two parallel, spaced apart posts 24 which form corner posts for crib 10. Posts 24 are connected at their upper ends by a horizontally oriented upper cross brace 26 and are connected at positions approximately one-third of the length thereof measured from the lower ends by a horizontally oriented lower cross brace 28. A plurality of equidistantly spaced apart vertical slats or rods 30 interconnect upper cross brace 26 and lower cross brace 28.

Figure 7:
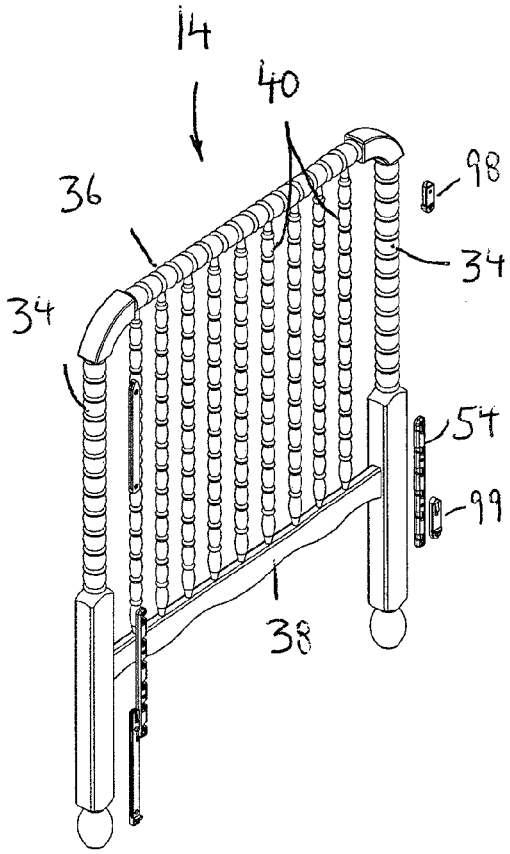
FIG. 7 is a perspective view of the headboard of the crib.

In like manner, as shown in FIG. 7, footboard 14 is formed by two parallel, spaced apart posts 34 which form corner posts for crib 10. Posts 34 are connected at their upper ends by a horizontally oriented upper cross brace 36 and are connected at positions approximately one-third of the length thereof measured from the lower ends by a horizontally oriented lower cross brace 38. A plurality of equidistantly spaced apart vertical slats or rods 40 interconnect upper cross brace 36 and lower cross brace 38.

During assembly, headboard 12 and footboard 14 are first assembled with two stabilizer bars 16 on opposite sides of crib 10, for example, according to the teachings of U.S. Pat. No. 4,639,956. Specifically, as shown in FIGS. 8-11, a vertically oriented bracket 54 has openings 56 through which screws (not shown) secure bracket 54 to an inner surface of each vertical corner post 24 and 34 near the lower end thereof. Each vertically oriented bracket 54 includes a plurality of vertically spaced open ended slots 58. Each slot 58 has an open mouth 60 and a blind base 61 which is positioned below the mouth 60 of each slot 58. The open mouths 60 of each bracket 54 face inwardly of the space defined by the crib frame, and actually face toward the open mouths 60 of the slots 58 on an opposing bracket 54 of the same headboard 12 or footboard 14.

Figure 12:
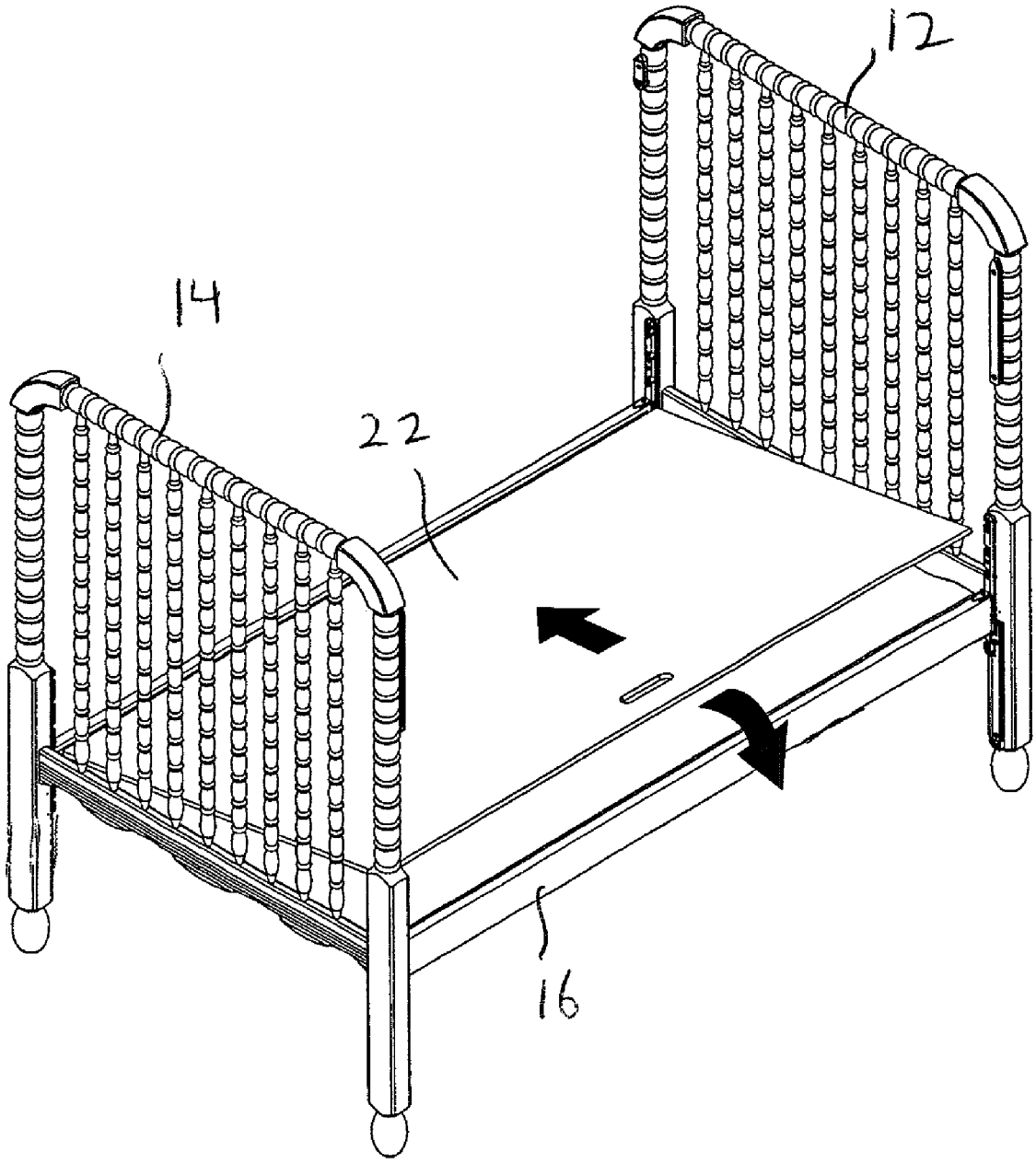
FIG. 12 is a perspective view showing assembly of the mattress support on the partially assembled crib.

Each stabilizer bar 16 is formed by an elongated, rectangular parallelepiped shaped bar 78 having an inwardly directed ledge 80 spaced slightly down from the upper end thereof for supporting mattress board 22 thereon. Each ledge 80 extends the length of bar 78, but can be made shorter in length than each respective rectangular parallelepiped shaped bar 78. Two mattress board locks 82 in the form of a flat, generally triangular shape are pivotally mounted to the upper surface of rectangular parallelepiped shaped bar 78 by screws 84. In this manner, when mattress board 22 is supported on ledges 80, as shown in FIG. 12, locks 82 can be pivoted inwardly to lock mattress board 22 in place. This attachment of mattress board locks 82 is performed at the factory so that the end consumer receives the same fully assembled.

Each stabilizer bar 16 has a pin plate 62 connected to each end thereof. Each pin plate 62 includes a first rectangular plate 64 positioned flush against one end surface of a stabilizer bar 16, an upper restraining plate 66 connected with the upper edge of first rectangular plate 64 and positioned flush against an upper surface of the same stabilizer bar 16, and a lower restraining plate 68 connected with the lower edge of first rectangular plate 64 and positioned flush against the lower surface of the same stabilizer bar 16. Pin plates 62 can be connected to the ends of stabilizer bars 16 by screws 70 extending through openings in first rectangular plate 64. Two pins 72 extend outwardly from each pin plate 62. Each pin 72 has a head 74 and a smaller diameter stem 76 which connects head 74 to first rectangular plate 64 of pin plate 62. The spacing between pins 72 on each plate 62 is equal to the spacing between adjacent slots 58 on each bracket 54. To initially engage stabilizer bars 16 onto their respective vertically oriented brackets 54, or to adjust the vertical position thereof, a stabilizer bar 16 on one side of crib 10 is first positioned in the space defined between two vertical corner posts 24 and 34, and then, with pins 72 thereof aligned with the mouths 60 of appropriate brackets 54, the pins 72 are moved through the respective open mouths 60. The mouth 60 of each slot 58 has a vertical height which is at least as large as the diameter of the head 74 of each pin 72 so that the pin 72 can easily enter the mouth 60 and then drop down and seat within the respective selected space defined in each bracket 54, with stem 76 of each pin 72 being seated in each blind base 61. Then, the same operation is provided with respect to the other stabilizer bar 16 on the opposite side of crib 10.

Figure 4:
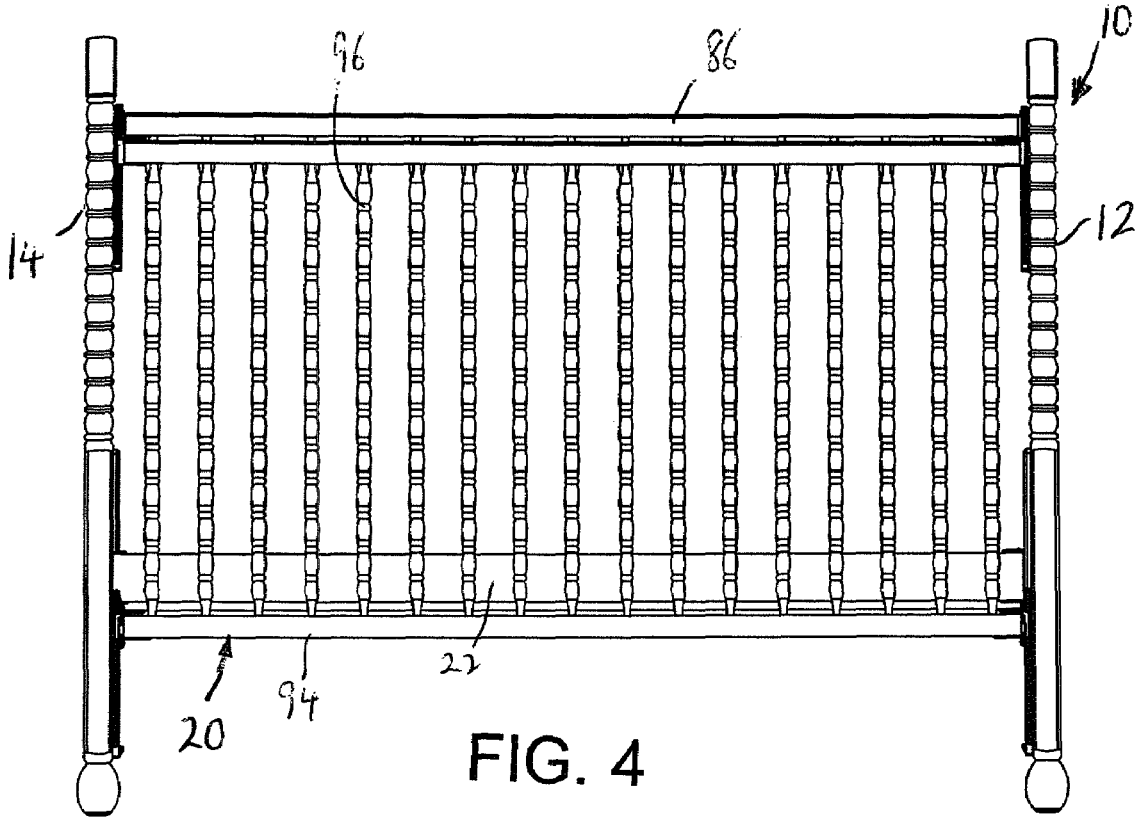
FIG. 4 is a side perspective view of the crib.
Figure 5:
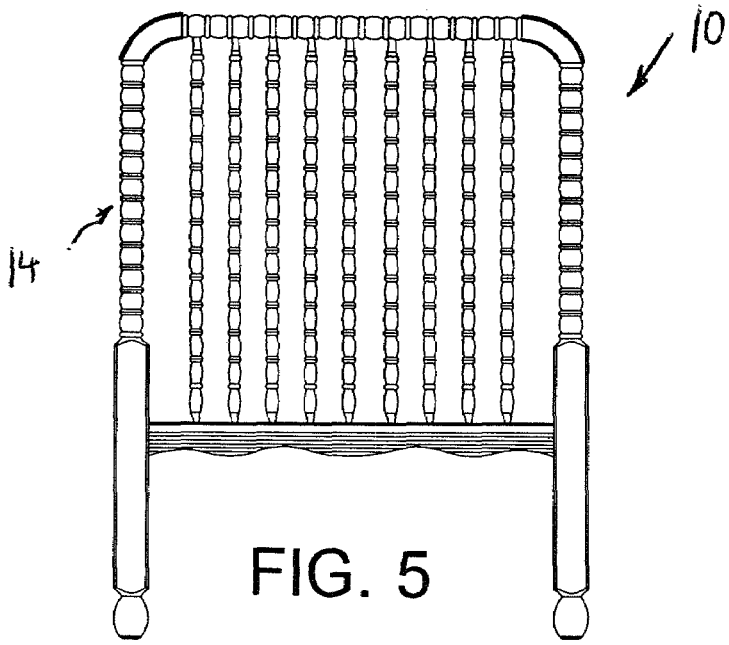
FIG. 5 is an end elevational view of the crib.

Stationary rail 18 and drop side rail 20 are constructed in an identical manner. As shown in FIGS. 1 and 4, stationary rail 18 includes an upper rail member 86 and a parallel, spaced apart lower rail member 88 connected together by plurality of equidistantly spaced apart vertical slats or rods 90. In like manner, drop side rail 20 includes an upper rail member 92 and a parallel, spaced apart lower rail member 94 connected together by plurality of equidistantly spaced apart vertical slats or rods 96.

Stationary rail 18 can be secured to headboard 12 and footboard 14 in any suitable manner, such as screws or the like. However, preferably, stationary rail is secured to headboard 12 in the manner disclosed in applicant's copending U.S. patent application Ser. No. 11/862,919, filed Sep. 27, 2007, the entire disclosure of which is incorporated herein by reference. Specifically, as shown in FIGS. 13-15, an upper rail support 98 is fixed at the factory to the upper end of each post 24, and a lower rail support 99 is fixed at the factory to the lower end each post 24 immediately below lower cross brace 28.

Upper rail support 98 includes an elongated main body 100 secured to the upper end of a respective post 24 and 34 on the same side of crib 10 by screws (not shown) through openings 102. A lower ledge 104 extends outwardly from the free end face of main body 100 at a position approximately one-quarter of the distance measured from the lower end thereof. A spring biased button 106 is provided at the upper end of main body 100. A front guide plate 108 is connected at the front face of main body 100 and has a width greater than that of the front face of main body 100 so as to extend outwardly a short distance on both sides of main body 100. In like manner, lower rail support 99 includes an elongated main body 110 secured to the upper end of the same respective post 24 and 34 by screws (not shown) through openings 112. A lower ledge 114 extends outwardly from the free end face of main body 110 at a position approximately one-quarter of the distance measured from the lower end thereof. A spring biased button 116 is provided at the upper end of main body 110. A front guide plate 118 is connected at the front face of main body 110 and has a width greater than that of the front face of main body 110 so as to extend outwardly a short distance on both sides of main body 110.

An end cap 120 is fixed at the factory to the ends of each upper rail member 86 and lower rail member 88. End cap 120 includes a bottom wall 122 that is flush against the lower surface of the respective rail member 86, 88, spaced apart side walls 124 that are connected to opposite side edges of bottom wall 122 and which are flush against side surfaces of the respective rail member 86, 88, and a rear wall 126 that also connects side walls 124 and which is flush against the end face of the respective rail member 86, 88. Two spaced apart, L-shaped walls 128 extend out as extensions of side walls 124 and are in facing relation to each other to form a guide channel 130 therebetween in parallel spaced relation from rear wall 126. Each end cap 120 is fixed to the ends of a rail member 86, 88 by screws (not shown) extending through bottom wall 122 and rear wall 126.

In this manner, as shown in FIGS. 13-16, end caps 120 are lowered such that front guides plates 108 of upper rail supports 98 slide within guide channels 130 thereof, and front guide plates 118 of lower rail supports 99 slide within guide channels 130 thereof, thereby preventing escape of end caps 120. During this sliding action, rear wall 126 pushes in spring biased buttons 106, 116. This sliding action continues until bottom walls 122 seat on lower ledges 104, 114, as shown in FIGS. 16-18. At this time, the upper edge of rear wall 124 rides past the lower edge of spring biased buttons 106, 116, whereby the spring action thereof biases buttons 106, 116 outwardly over the upper edge of rear wall 126 and part of the upper surface of rail members 86, 88, thereby capturing rail members 86, 88 in a releasable locking manner.

Thus, stationary rail 18 can be easily assembled by the consumer without any tools.

To assemble drop side rail 20, reference is first made to FIGS. 19-21. Specifically, an elongated upper guide 132 having a substantially H-shaped cross-sectional configuration is mounted at the factory to the upper end of a post 24 and 34 on the opposite side of crib 10 from stationary side rail 18. Upper guide 132 thereby includes an elongated rear plate 134, a parallel, spaced apart elongated front plate 136, and a connecting leg 138 of a lesser width which connects together rear plate 134 and front plate 136. As a result, two guide channels 140 are formed on opposite sides of connecting leg 138 between rear plate 134 and front plate 136. Openings 142 extend through front plate 136, connecting leg 138 and rear plate 134 for receiving screws (not shown) to secure upper guide 132 to post 24 or 34. The lower end of upper guide 132 is closed at 144.

As shown in FIGS. 23 and 24, an upper rail guide 150 is secured at the factory to each end of upper rail member 92. Upper rail guide 150 includes a planar wall 152 that sits flush against one end surface of upper rail member 92, and which includes a projection 154 that is received in an opening 155 in the end surface of upper rail member 92 with a friction fit for securing planar wall 152 to the end surface of upper rail member 92. Two spaced apart, L-shaped walls 156 extend outwardly at right angles from side edges of planar wall 152 and are in facing relation to each other to form a guide channel 158 therebetween. Thus, front plate 136 of upper guide 132 can be slid into guide channel 158 to slidably receive rail guide 150 thereon. In such condition, rail guide 150 is limited at its lower extent by the closed lower end 144. In addition, an inwardly facing lower plate 160 extends from the lower edge of planar wall 152 to a position where it sits flush against the lower surface of upper rail member 92. Lower plate 160 has an opening 162 therein through which a screw 164 can be inserted for fixing lower plate 160 to upper rail member 92. In addition, a triangular shaped side wall 161 is secured to an inner edge of planar wall 152 and lower plate 160, sits flush against an inner surface of upper rail member 92 and can include an opening (not shown) through which a screw (not shown) is inserted for securing side wall 161 to upper rail member 92.

Figure 26:
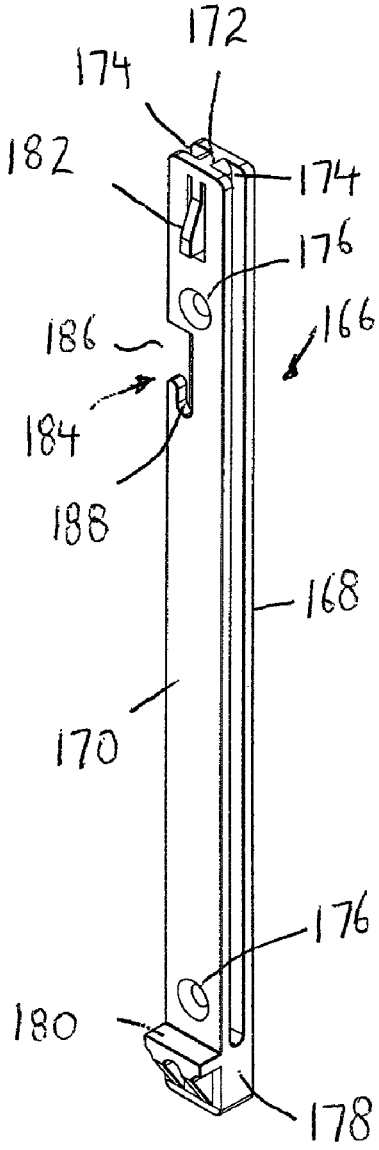
FIG. 26 is a perspective view of the elongated lower guide for the drop side rail for use with the headboard.
Figure 27:
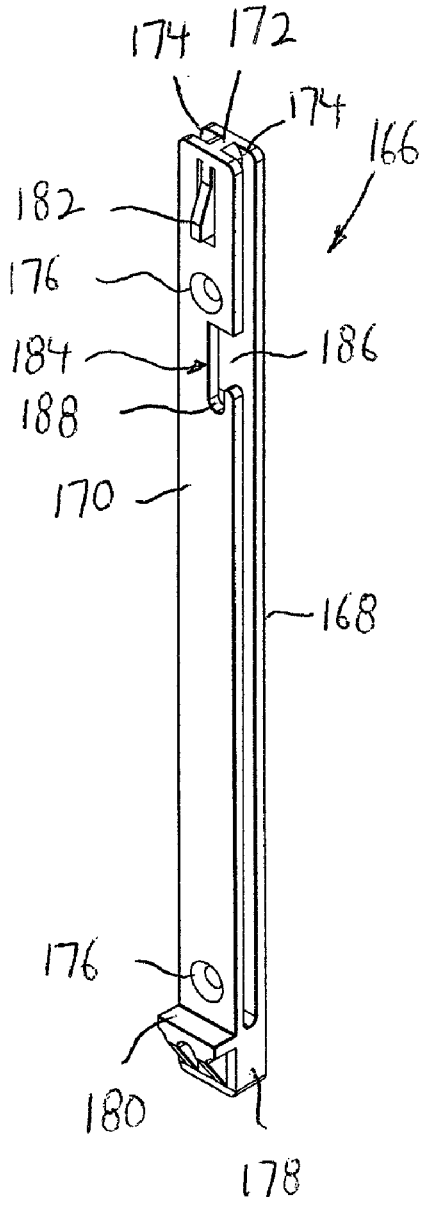
FIG. 27 is a perspective view of the elongated lower guide for the drop side rail for use with the footboard.
Figure 34:
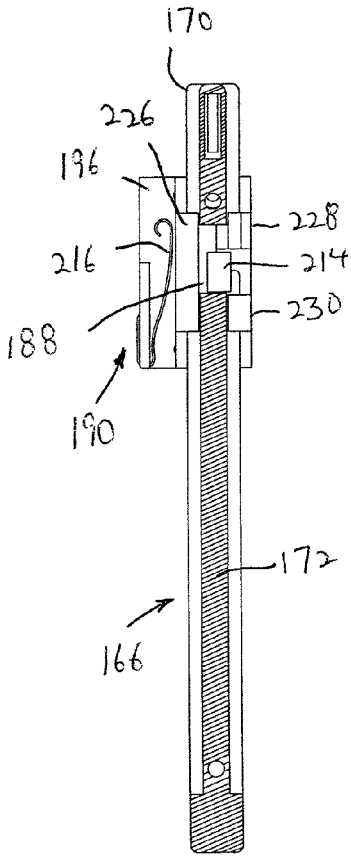
FIG. 34 is a longitudinal cross-sectional view of the arrangement of FIG. 32.
Figure 33:
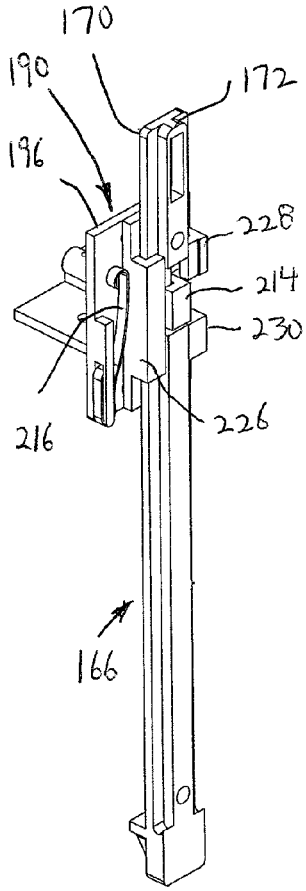
FIG. 33 is a perspective view of the arrangement of FIG. 32, with the rear plate of the elongated lower guide removed for better viewing.
Figure 32:
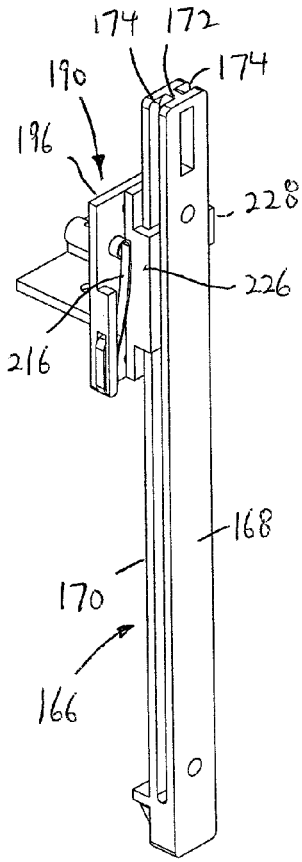
FIG. 32 is a perspective view of a lower rail lock assembly mounted in a locked position on an elongated lower guide.

As shown in FIGS. 21, 26 and 27, an elongated lower guide 166 having a substantially H-shaped cross-sectional configuration is mounted at the factory to the lower end of a post 24 or 34 on the opposite side of crib 10 from stationary side rail 18. Lower guide 166 thereby includes a an elongated rear plate 168, a parallel, spaced apart elongated front plate 170, and a connecting leg 172 of a lesser width which connects together rear plate 168 and front plate 170. As a result, two guide channels 174 are formed on opposite sides of connecting leg 172 between rear plate 168 and front plate 170. Openings 176 extend through front plate 170, connecting leg 172 and rear plate 168 for receiving screws (not shown) to secure lower guide 166 to post 24 or 34. The lower end of lower guide 166 is closed at 178.

An inwardly extending lower abutment 180 is provided at the lower end of front plate 170 adjacent closed lower end 178. A spring biased button 182 is provided at the upper end of front plate 170. In addition, each front plate 170 includes an L-shaped slot 184. Each slot 184 has an open mouth 186 and a blind base 188 which is positioned below the mouth 186 of each slot 184. The open mouths 186 of each lower guide 166 face inwardly of the space defined by the crib frame.

As shown in FIGS. 25, 26 and 27, a lower rail lock assembly 190 is secured at the factory to each end of lower rail member 94. Lower rail lock assembly 190 includes a rail securement member 192 which secures lower rail lock assembly 190 to a respective lower rail member 94, and a lower rail guide 194 secured to rail securement member 192 and which slides along elongated lower guide 166.

Rail securement member 192 includes a planar wall 196 that sits flush against one end surface of lower rail member 94, and which includes a projection 198 that is received in an opening 200 (FIG. 25) in the end surface of lower rail member 94 with a friction fit for securing planar wall 196 to the end surface of lower rail member 94. An inwardly facing lower plate 202 extends from the lower edge of planar wall 196 to a position where it sits flush against the lower surface of lower rail member 96. Lower plate 202 has an opening 204 therein through which a screw 206 (FIG. 25) can be inserted for fixing lower plate 202 to lower rail member 94. In addition, a triangular shaped side wall 208 is secured to an inner edge of planar wall 196 and lower plate 202, sits flush against an inner surface of lower rail member 94 and can include an opening (not shown) through which a screw (not shown) can be inserted for securing side wall 208 to lower rail member 94.

Planar wall 196 of rail securement member 192 includes two transverse elongated slots 210 adjacent upper and lower edges thereof. A stub side wall 212 is secured to the side edge of planar wall 196 which is opposite side wall 208 and extends in an opposite direction from side wall 208. An L-shaped lock 214 extends from the surface of planar wall 196 on the same side thereof as stub side wall 212. L-shaped lock 214 is formed adjacent the opposite side edge of planar wall 196 from stub side wall 212 and faces stub side wall 212. Lastly, a leaf spring 216 has one end wrapped about the lower end of stub side wall 212 and thereby connected thereto, with the opposite free end in facing relation to L-shaped lock 214.

Lower rail guide 194 includes a planar wall 218 that sits flush against planar wall 196, and is secured thereagainst for sliding movement in a transverse direction. Specifically, pins, rivets or the like 220 extend through holes 222 in planar wall 218 and through slots 210 and are secured at their opposite ends by rivet caps 224. As a result, movement of rivets 220 in slots 210 result in slidable movement of lower rail guide 194 relative to rail securement member 192. An L-shaped guide wall 226 extends outwardly from one side edge of planar wall 218 and two vertically spaced apart L-shaped guide walls 228 and 230 extend outwardly from the opposite side edge of planar wall 218, with L-shaped guide wall 226 and L-shaped guide walls 228 and 230 facing each other. An opening or gap 232 is formed in planar wall 218 between L-shaped guide walls 228 and 230, and L-shaped lock 214 is slidable therein.

With this arrangement, L-shaped guide walls 226, 228 and 230 receive elongated front plate 170 of an elongated lower guide 166 to slidingly support rail securement member 192 to elongated lower guide 166. As shown in the locked position in FIGS. 32-34, L-shaped lock 214 is locked in blind base 188 so that drop side rail 20 is releasably locked in its raised position. In this position, spring 216 applies pressure against L-shaped guide wall 226 which has the effect of pulling rail securement member 192 to the left in FIG. 34 which, in turn, pulls L-shaped lock 214 against a side wall which defines blind base 188. Further, in this position, spring biased button 182 is lodged against the upper edge of planar walls 196 and 218 so as to prevent inadvertent removal of L-shaped lock 214 from blind base 188, and thereby to prevent inadvertent lowering of drop side rail 20. The position of all elements of crib 10 in this raised position of drop side rail 20 is shown in FIGS. 32A-34A.

Figure 37:
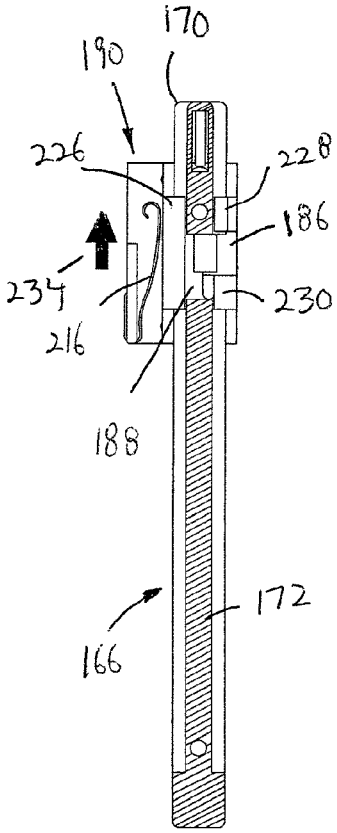
FIG. 37 is a longitudinal cross-sectional view of the arrangement of FIG. 35.
Figure 36:
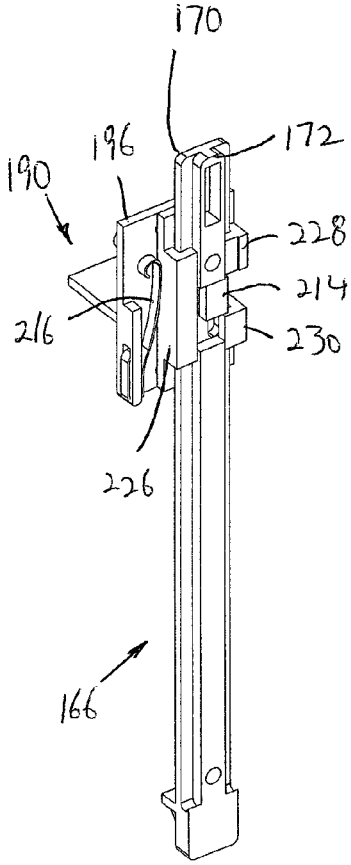
FIG. 36 is a perspective view of the arrangement of FIG. 35, with the rear plate of the elongated lower guide removed for better viewing.
Figure 35:
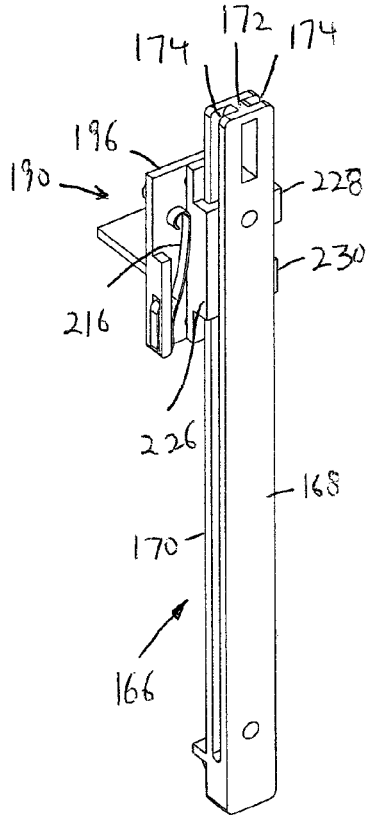
FIG. 35 is a perspective view of a lower rail lock assembly raised slightly in the blind base in an elongated lower guide.

In order to lower drop side rail 20, spring biased button 182 is pushed in, and drop side rail 20 is raised in the direction of arrow 234 in blind base 188 until L-shaped lock 214 is in facing relation to open mouth 186, as shown in FIGS. 35-37. In this position, spring 216 still applies pressure against L-shaped guide wall 226 which has the effect of pulling rail securement member 192 to the left in FIG. 37 which, in turn, pulls L-shaped lock 214 to the left away from open mouth 186.

Figure 40:
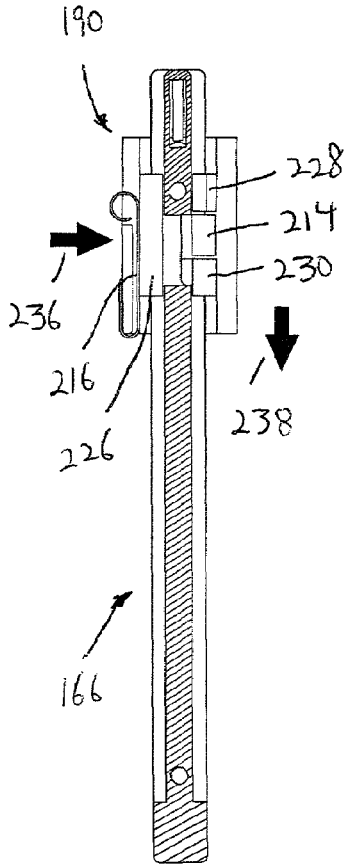
FIG. 40 is a longitudinal cross-sectional view of the arrangement of FIG. 38.
Figure 39:
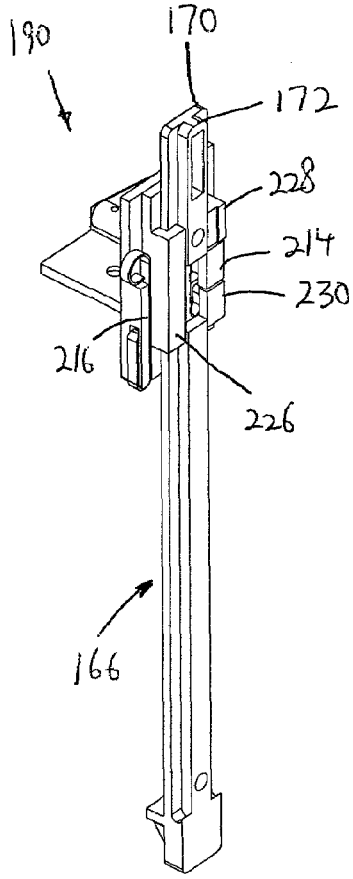
FIG. 39 is a perspective view of the arrangement of FIG. 38, with the rear plate of the elongated lower guide removed for better viewing.
Figure 38:
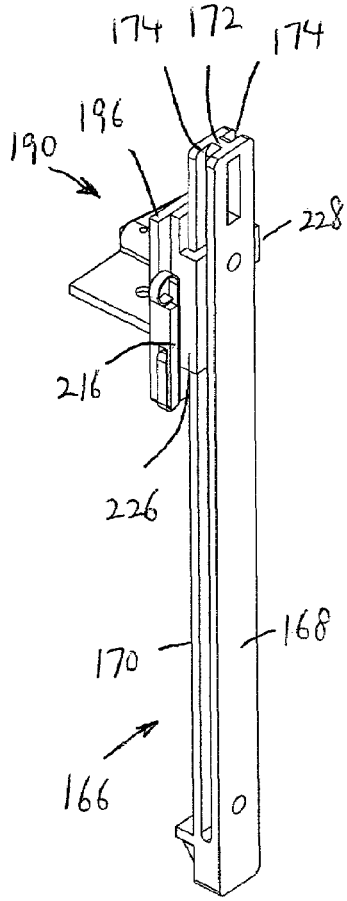
FIG. 38 is a perspective view of a lower rail lock assembly raised slightly in the blind base and pushed out of the open mouth in an elongated lower guide.
Figure 43:
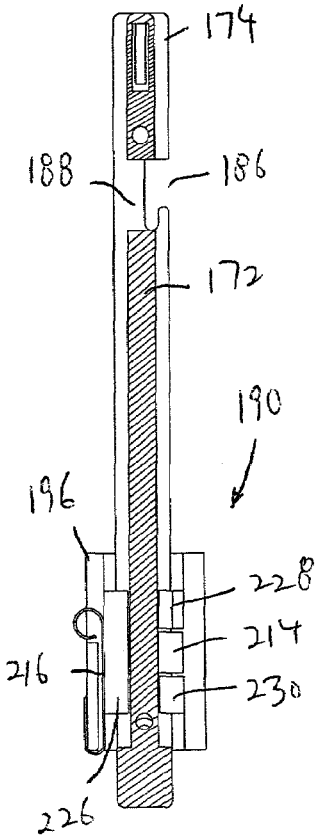
FIG. 43 is a longitudinal cross-sectional view of the arrangement of FIG. 41.
Figure 42:
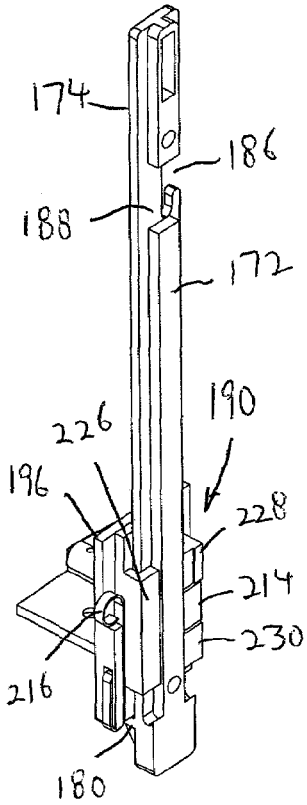
FIG. 42 is a perspective view of the arrangement of FIG. 41, with the rear plate of the elongated lower guide removed for better viewing.
Figure 41:
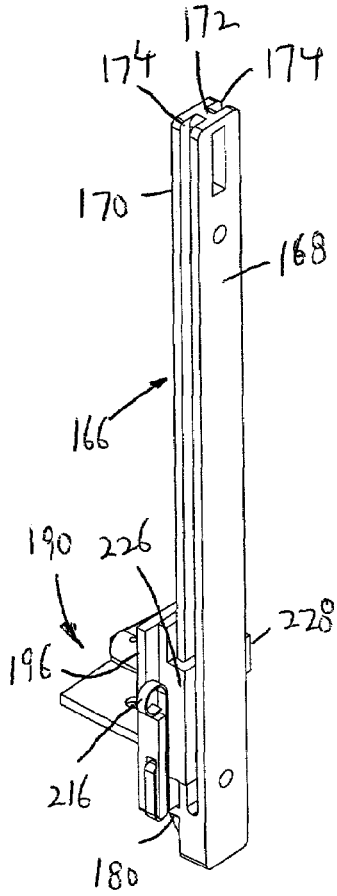
FIG. 41 is a perspective view of a lower rail lock assembly in its lowered position on an elongated lower guide.

In this position, lower rail member 94 of drop side rail 20 is then pushed in, for example, by a person's foot. This has the effect of pushing rail securement member 192 inwardly in the direction of arrow 236, as shown in FIGS. 38-40, so that spring 216 is compressed and L-shaped lock 214 is removed out of open mouth 186. In this position, L-shaped lock 214 is positioned between and in line with L-shaped guide walls 228 and 230, and is adapted to slide therewith. Thus, drop side rail 20 can now be lowered in the direction of arrow 238 (FIG. 40), until it is lowered to the position shown in FIGS. 41-43, in which plate 196 rests on lower abutment 180. The position of all elements of crib 10 in this lowered position of drop side rail 20 is shown in FIGS. 41A-43A.

To raise drop side rail 20, the reverse operation is performed.

It will therefore be appreciated that the present invention provides a crib that prevents accidental removal and/or lowering of drop side rail. Specifically, unlike the arrangement in U.S. Pat. No. 4,724,556, L-shaped guide walls 226, 228 and 230 are always in guiding engagement with opposite sides of elongated lower guide 166, regardless of whether L-shaped lock 214 is in engagement in slot 58 or not. This is because of the two part construction of lower rail lock assembly 190 including rail securement member 192 and lower rail guide 194, as opposed to the unitary one part construction of U.S. Pat. No. 4,724,556. As a result, in addition to the drop side rail being prevent from inadvertently lowering, the drop side rail cannot inadvertently detach from the crib, and is stably held to the corner posts at all times by L-shaped guide walls 226, 228 and 230 which are always in guiding engagement with opposite sides of elongated lower guide 166.

It will be appreciated that lower rail lock assembly 190 can be provided on only one end of drop side rail 20, with the opposite end having a mere sliding arrangement similar to that of upper rail guide 150.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A connecting arrangement for slidably securing the drop side rail to respective vertical posts of the headboard and footboard on an opposite side of the crib, said connecting arrangement including:

an elongated guide secured to a vertical post of at least one of the headboard and the footboard, said elongated guide including an opening therein, a rail guide slidably mounted along said elongated guide in a lengthwise direction thereof, said rail guide including opposing members that are both always in guiding engagement with opposite sides of said elongated guide, a rail securement member fixedly secured to at least one end of said drop side rail such that said rail securement member is prevented from moving relative to said drop side rail, said rail securement member being slidably connected with said rail guide for sliding movement relative to said rail guide in a direction transverse to said lengthwise direction, said rail securement member including a locking member, and a biasing arrangement for biasing said rail securement member in a transverse direction relative to said rail guide to move said locking member into said opening of said elongated guide, wherein, to lower the drop side rail, the drop side rail must be moved laterally against a biasing force of said biasing arrangement to remove said locking member from said opening whereupon said rail lock assembly can slide along said elongated guide.

2. A connecting arrangement for slidably securing the drop side rail to respective vertical posts of the headboard and footboard on an opposite side of the crib, said connecting arrangement including:

an elongated guide secured to a vertical post of at least one of the headboard and the footboard, said elongated guide including an opening therein, and said opening in said elongated guide includes an open mouth at one side of said elongated guide, and a blind base extending in open communication with said open mouth in a lengthwise direction of said elongated guide, a rail guide slidably mounted along said elongated guide in a lengthwise direction thereof, said rail guide including opposing members that are both always in guiding engagement with opposite sides of said elongated guide, a rail securement member secured to at least one end of said drop side rail, said rail securement member being slidably connected with said rail guide for sliding movement relative to said rail guide in a direction transverse to said lengthwise direction, said rail securement member including a locking member, and a biasing arrangement for biasing said rail securement member in a transverse direction relative to said rail guide to move said locking member into said opening of said elongated guide, wherein to lower the drop side rail, the drop side rail must be first raised to remove said locking member from said blind base and into alignment with said open mouth, then moved laterally against a biasing force of said biasing arrangement to remove said locking member from said open mouth of said opening, whereupon the rail lock assembly can slide along said elongated guide.

3. A connecting arrangement according to claim 1, wherein said biasing arrangement is engaged between said rail securement member and said rail guide for biasing said rail securement member in a transverse direction relative to said rail guide to move said locking member into said opening.

4. A connecting arrangement according to claim 3, wherein said biasing arrangement includes a spring arranged between said first and second members for biasing said first and second members apart.

5. A connecting arrangement according to claim 1, wherein said elongated guide includes at least one channel, and said opposing members are both always in guiding engagement within said at least one channel.

6. A connecting arrangement for slidably securing the drop side rail to respective vertical posts of the headboard and footboard on an opposite side of the crib, said connecting arrangement including:

an elongated guide secured to a vertical post of at least one of the headboard and the footboard, said elongated guide including an opening therein, a rail guide slidably mounted along said elongated guide in a lengthwise direction thereof, said rail guide including opposing members that are both always in guiding engagement with opposite sides of said elongated guide, and said opposing members include:

a first L-shaped guide wall at one side, and a second L-shaped guide wall at an opposite side, a rail securement member secured to at least one end of said drop side rail, said rail securement member being slidably connected with said rail guide for sliding movement relative to said rail guide in a direction transverse to said lengthwise direction, said rail securement member including a locking member, and a biasing arrangement for biasing said rail securement member in a transverse direction relative to said rail guide to move said locking member into said opening of said elongated guide, wherein, to lower the drop side rail, the drop side rail must be moved laterally against a biasing force of said biasing arrangement to remove said locking member from said opening whereupon said rail lock assembly can slide along said elongated guide.

7. A connecting arrangement according to claim 6, wherein said at least one guide wall further includes a third L-shaped guide wall at said opposite side in spaced relation from said second L-shaped guide wall, with a gap therebetween, and said biasing arrangement biases said locking member through said gap and into said opening.

8. A connecting arrangement for slidably securing the drop side rail to respective vertical posts of the headboard and footboard on an opposite side of the crib, said connecting arrangement including:

an elongated guide secured to a vertical post of at least one of the headboard and the footboard, said elongated guide including an opening therein, a rail guide slidably mounted along said elongated guide in a lengthwise direction thereof, said rail guide including opposing members that are both always in guiding engagement with opposite sides of said elongated guide, a rail securement member secured to at least one end of said drop side rail, said rail securement member being slidably connected with said rail guide for sliding movement relative to said rail guide in a direction transverse to said lengthwise direction, said rail securement member including a locking member, said rail guide includes a first plate and said rail securement member includes a second plate, one of said first and second plates having at least one elongated transverse slot therein and the other of said first and second plates having at least one opening therein, and further comprising a pin arrangement extending through the at least one opening and slidably mounted in said at least one elongated transverse slot for slidably mounting said rail securement member relative to said rail guide, and a biasing arrangement for biasing said rail securement member in a transverse direction relative to said rail guide to move said locking member into said opening of said elongated guide, wherein, to lower the drop side rail, the drop side rail must be moved laterally against a biasing force of said biasing arrangement to remove said locking member from said opening whereupon said rail lock assembly can slide along said elongated guide.

9. A connecting arrangement according to claim 1, wherein:

said elongated guide is secured to a lower portion of the vertical post of at least one of said headboard and said footboard, and said rail securement member is secured to a lower portion of said at least one end of said drop side rail.

10. A connecting arrangement according to claim 9, further comprising an elongated upper guide secured to an upper end of the vertical post of the at least one of said headboard and said footboard, and an upper rail guide secured to an upper portion at each end of the drop side rail for sliding engagement with a respective elongated upper guide.

11. A crib comprising:

a headboard having a pair of spaced apart vertical posts;

a footboard having a pair of spaced apart vertical posts;

first and second stabilizer bars, each having opposite ends;

a connecting arrangement for connecting each end of each stabilizer bar to a respective vertical post;

a first side rail secured to respective vertical posts of the headboard and footboard on one side of the crib;

a drop side rail; and a connecting arrangement for slidably securing the drop side rail to respective vertical posts of the headboard and footboard on an opposite side of the crib, said connecting arrangement including:

an elongated guide secured to a vertical post of at least one of said headboard and said footboard, said elongated guide including an opening therein, a rail guide slidably mounted along said elongated guide in a lengthwise direction thereof, said rail guide including opposing members that are both always in guiding engagement with opposite sides of said elongated guide, a rail securement member fixedly secured to at least one end of said drop side rail such that said rail securement member is prevented from moving relative to said drop side rail, said rail securement member being slidably connected with said rail guide for sliding movement relative to said rail guide in a direction transverse to said lengthwise direction, said rail securement member including a locking member, and a biasing arrangement for biasing said rail securement member in a transverse direction relative to said rail guide to move said locking member into said opening of said elongated guide, wherein, to lower said drop side rail, said drop side rail must be moved laterally against a biasing force of said biasing arrangement to remove said locking member from said opening whereupon said rail lock assembly can slide along said elongated guide.

12. A crib according to claim 11, wherein:

said opening in said elongated guide includes an open mouth at one side of said elongated guide, and a blind base extending in open communication with said open mouth in a lengthwise direction of said elongated guide, wherein to lower said drop side rail, said drop side rail must be first raised to remove said locking member from said blind base and into alignment with said open mouth, then moved laterally against a biasing force of said biasing arrangement to remove said locking member from said open mouth of said opening, whereupon said rail lock assembly can slide along said elongated guide.

13. A crib according to claim 11, wherein said biasing arrangement is engaged between said rail securement member and said rail guide for biasing said rail securement member in a transverse direction relative to said rail guide to move said locking member into said opening.

14. A crib according to claim 13, wherein said biasing arrangement includes a spring arranged between said first and second members for biasing said first and second members apart.

15. A crib according to claim 11, wherein said elongated guide includes at least one channel, and said opposing members are both always in guiding engagement within said at least one channel.

16. A crib according to claim 11, wherein said opposing members include:

a first L-shaped guide wall at one side, and a second L-shaped guide wall at an opposite side.

17. A crib according to claim 16, wherein said at least one guide wall further includes a third L-shaped guide wall at said opposite side in spaced relation from said second L-shaped guide wall, with a gap therebetween, and said biasing arrangement biases said locking member through said gap and into said opening.

18. A crib according to claim 11, wherein said rail guide includes a first plate and said rail securement member includes a second plate, one of said first and second plates having at least one elongated transverse slot therein and the other of said first and second plates having at least one opening therein, and further comprising a pin arrangement extending through the at least one opening and slidably mounted in said at least one elongated transverse slot for slidably mounting said rail securement member relative to said rail guide.

19. A crib according to claim 11, wherein:

said elongated guide is secured to a lower portion of the vertical post of at least one of said headboard and said footboard, and said rail securement member is secured to a lower portion of said at least one end of said drop side rail.

20. A crib according to claim 19, further comprising an elongated upper guide secured to an upper end of the vertical post of the at least one of said headboard and said footboard, and an upper rail guide secured to an upper portion at each end of the drop side rail for sliding engagement with a respective elongated upper guide.

* * * * *